United States Patent [19]

Paradisi et al.

[11] 4,054,012

[45] Oct. 18, 1977

[54] STARTER STRIP FOR METAL SIDING

[76] Inventors: Remo Santi Paradisi, 965 Beach Blvd., Hamilton, Ontario; Robert William Rogaski, 45 Burningham Crescent, Pickering, Ontario, both of Canada

[21] Appl. No.: 700,511

[22] Filed: June 28, 1976

[30] Foreign Application Priority Data

July 18, 1975 Canada ..... 231812

[51] Int. Cl.[2] ..... E04D 1/34; E04D 1/00

[52] U.S. Cl. ..... 52/544; 52/531; 52/519; 52/276; 52/545; 52/551

[58] Field of Search ..... 52/518, 529, 545, 530, 52/531, 551, 544, 276

[56] References Cited

U.S. PATENT DOCUMENTS

| | | | |
|---|---|---|---|
| 2,226,886 | 12/1940 | Willis | 52/518 X |
| 2,766,861 | 10/1956 | Abramson | 52/531 |
| 3,226,901 | 1/1966 | Harter | 52/545 X |
| 3,282,009 | 11/1966 | Chalmers | 52/545 X |
| 3,325,952 | 6/1967 | Trachtenberg | 52/530 X |
| 3,738,076 | 6/1973 | Kessler | 52/551 X |
| 3,815,310 | 6/1974 | Kessler | 52/531 |

FOREIGN PATENT DOCUMENTS

| | | | |
|---|---|---|---|
| 688,713 | 6/1964 | Canada | 52/531 |

*Primary Examiner*—Price C. Faw, Jr.
*Assistant Examiner*—Robert C. Farber
*Attorney, Agent, or Firm*—Hirons & Rogers

[57] ABSTRACT

A starter strip and siding strip combination comprises a siding strip of the kind having a hooked lower edge. The starter strip consists of an upper nailing portion having a downwardly-outwardly-extending main flange projecting from its front face and a return retainer flange extending horizontally from the main flange toward the front face, the free end tip of the return flange being rounded. The hooked lower edge of the first siding strip can be engaged with the flanges while in a horizontal orientation, in which the siding strip floats freely and can easily be moved sideways for adjustment. The siding strip can then be rotated into the vertical position against the associated structure and nailed thereto, without the possibility of disengagement from the starter strip, either during installation or during subsequent expansion and contraction of the siding by daily and seasonal temperature changes.

8 Claims, 3 Drawing Figures

STARTER STRIP FOR METAL SIDING

FIELD OF THE INVENTION

This invention is concerned with improvements in or relating to a combination of a starter strip and a siding strip.

REVIEW OF THE PRIOR ART

Siding is now almost universally applied in the form of horizontal strips of uniform width, the strips being applied from the bottom up, and each strip having a lower edge which is arranged to interlock with the upper edge of the previously-applied lower strip. The installation of the siding usually commences with the fastening to the structure of a special starter strip, which interlocks with the lower edge of the lower-most strip, and is at least partially concealed by that strip when the latter is fixed in position.

Such a starter strip typically consists of a downwardly-extending flange protruding from a narrow nailing member and such strips cause considerable problems both during and after installation. Typically the installer jams the first siding strip tightly against the starter strip while the siding strip is nailed into place, and it is difficult to move the two strips sideways relative to each other for adjustment. The engagement between the starter and first siding strips is such that the relative movement that inevitally occurs in a building structure, usually due to temperature changes, produces irritating noises known as "bird-calls". Another effect of daily and seasonal temperature changes is to cycle the interlock between an over-tight engagement, which tends to spring the interlock open, and an overloose engagement, when the interlock can become completely released. Once release has taken place it is difficult, if not impossible, to reengage the interlock and the lower siding strip is then free to flap, decreasing the weathertightness of the structure and causing irritating noises.

DEFINITION OF THE INVENTION

It is an object of the invention to provide a new starter strip and siding strip combination.

It is a more specific object to provide a new starter strip and siding strip combination permitting easy relative movement between the starter strip and the engaged siding strip during installation.

It is a further object to provide a new starter strip and siding strip combination ensuring maintenence of the interlock of the starter strip with an engaged siding strip despite the effects of daily and seasonal temperature changes.

In accordance with the present invention there is provided a starter strip in combination with a siding strip having a hooked lower end, the starter strip comprising an elongated nailing portion having a front face and a rear face for application to an associated structure with the rear face contacting the said structure, a downwardly-outwardly-extending main flange portion extending from the said front face so as to be spaced progressively from the front face, and a return flange portion extending from the main flange portion toward the said front face to provide between itself and the main flange portion a recess into which the top of the hooked lower end of an installed siding strip enters, the tip of the return flange portion being overlaid by the hooked lower end of an installed siding strip to prevent downward movement of the siding strip lower end out of engagement with the return flange.

Preferably, the said return flange is disposed so as to be substantially horizontal when the strip is fixed to the associated structure.

The said main and return flanges may be formed by folding a thin metal strip into two parallel layers and the tip of the return flange that is overlaid by the hooked lower end of the siding strip is of rounded cross-section.

DESCRIPTION OF THE DRAWINGS

Starter strip and siding strip combinations which are particular preferred embodiments of the invention will now be described, by way of example, with reference to the accompanying diagrammatic drawing wherein.

DESCRIPTION OF THE PREFERRED EMBODIMENTS

Figure 1:
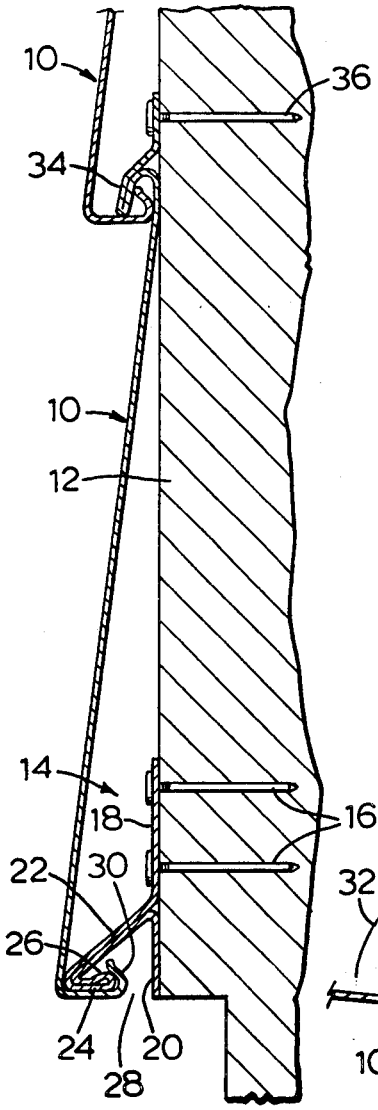
FIG. 1 is a cross-section through a first embodiment showing the starter strip installed on a suitable associated structure and a first siding strip installed thereon.
Figure 2:
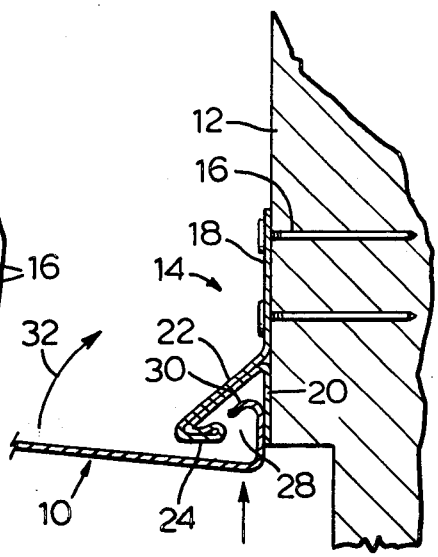
FIG. 2 is a similar section showing a preferred way in which the first siding strip may be engaged with the starter strip for horizontal adjustment.

Referring especially to FIGS. 1 and 2, showing a first embodiment, the wall of an associated structure to which the siding strips 10 are fastened is indicated by the reference 12. A starter strip 14 fastened to the structure, for example by nails 16, consists of a first upper nailing part 18 and a lower part 20. The starter strip is produced by roll-forming from a narrow originating strip of metal, such as aluminum or steel, and the part of the originating strip between the parts 18 and 20 is bent during the roll-forming operation to form a main flange 22 and a return flange 24. The part 20 can be omitted.

It will be seen that both of the flanges 22 and 24 are formed of a double thickness of material and are therefore especially rigid. The main flange 22 extends outwardly and downwardly from the front face of the nailing part 18 so as to be spaced progressively from the front face, while the return flange 24 extends from the bottommost edge of the main flange toward the front face of the starter strip portion 20. The angular relation between the main and return flanges preferably is such that the latter is substantially horizontal when the starter strip is in position on the structure, although some deviation from the true horizontal is permissible. The free end tip 26 of the return flange is formed to a definite rounded cross-section for a purpose explained below. The elongated slot opening 28 between the tip 26 and the front face of the part 20 is of a width sufficient to pass therethrough the turned lower edge 30 forming the hooked lower end of the first siding strip 10 which is to be engaged with the starter strip.

Referring to FIG. 2 in addition to FIG. 1, a preferred method of applying the first siding strip is to engage the hooked lower end 30 thereof over the return flange 24, as illustrated by FIG. 2, with the plane of the siding strip almost horizontal, the gap 28 being just sufficient to permit the hooked end to pass therethrough in this orientation. The siding strip now "floats freely" relative to the starter strip and in this condition can easily be moved sideways relative to the starter strip for adjustment of its position along the structure. The two strips will remain in engagement during this sideways movement without the need, as with prior art structures, to jam the first siding strip as tightly as possible up against the starter strip. The siding strip is now rotated in the direction of the arrow 32 until its upper end engages the support structure and can be nailed thereto, as by nails 36. The horizontal width of the return flange 24 is just less than the corresponding horizontal internal width of the siding strip hooked end which is engaged over the return flange, so that the hooked end and the flange cannot become disengaged during such rotation. The lower end of the next siding strip 10 is then engaged with the upper end of the first siding strip, and so on until the wall is complete. Strips of insulating material may be interposed between each siding strip and the wall structure in known manner, but are not illustrated herein.

It is of course not essential to employ this engagement-rotation installation procedure and the starter strip is equally effective if the siding strip is engaged therewith in a vertical orientation ready for nailing directly to the structure.

It will be seen that the rounded tip 26 of the return flange 20 is operative to facilitate the desired sideways sliding and also the rotation of the siding strip into position for nailing the upper end in place. It will also be seen from FIG. 1 that once in position the lower hooked end 30 of the first siding strip is retained against upwards movement by its engagement with both flanges, and against downwards movement by engagement between the hooked end and the upper face of the return flange. Owing to the double thickness of the two flanges, the rounded tip 26 and the relative angular dispositions of the two flanges they are much more rigid than a single siding thickness in extension, so that expansion of the siding strip will merely result in its bowing upward. Contraction of the siding strip will apply tension to the flanges 22 and 24 and may bend the flange 22 but will not alter the relative orientation of the flanges to any significant extent, so that they will retain their interlocking engagement with the siding strip, and will not be disengaged by subsequent expansion.

Figure 3:
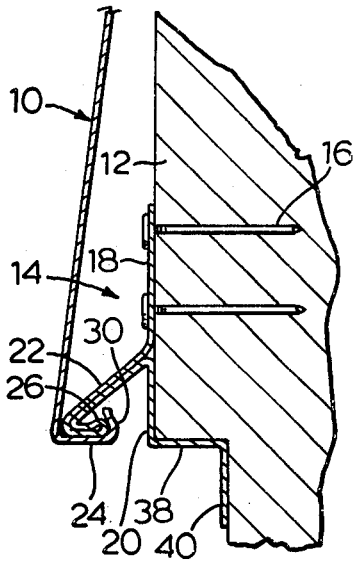
FIG. 3 is a similar section of a second embodiment permitting a positive seal between the starter strip and the associated structure.

In the embodiment illustrated by FIG. 3 the lower nailing part 20 is extended horizontally rearwards at 8 behind the first portion 18 to engage herewith the lower edge of the structure, and again downwards at 40 in order to provide for full and complete sealing of the structure at this lower edge. The sealing can be completed by a bead of caulking (not illustrated) in the corner into which the parts 38 and 40 fit.

We claim:

1. A starter strip in combination with a siding strip having a hooked lower end, the starter strip comprising an elongated nailing portion having a front face and a rear face for application to an associated structure with the rear face contacting the said structure, a downwardly-outwardly-extending main flange portion extending from the said front face so as to be spaced progressively from the front face, and a return flange portion extending from the main flange portion toward the said front face to provide between itself and the main flange portion a recess into which the top of the hooked lower end of an installed siding strip enters, the tip of the return flange portion being overlaid by the hooked lower end of an installed siding strip to prevent downward movement of the siding strip lower end out of engagement with the return flange.

2. A starter strip and siding strip as claimed in claim 1, wherein the said starter strip return flange portion is disposed so as to be substantially horizontal when the starter strip is fixed to the associated structure.

3. A starter strip and siding strip as claimed in claim 1, wherein the starter strip main and return flanges are formed by folding a thin metal strip into two parallel layers and the tip of the return flange that is overlaid by the siding strip hooked lower end is of rounded cross-section.

4. A starter strip and siding strip as claimed in claim 2, wherein the starter strip main and return flanges are formed by folding a thin metal strip into two parallel layers and the tip of the return flange that is overlaid by the siding strip hooked lower end is of rounded cross-section.

5. A starter strip and siding strip as claimed in claim 1, wherein the said nailing portion has a first portion from which the main flange extends and a second portion which extends below the said main flange, the said second portion also projecting behind the first portion to engage around the lower edge of the structure to which the nailing strip is fastened.

6. A starter strip and siding strip as claimed in claim 1, wherein the said siding strip hooked lower end is hooked over the tip of the starter strip return flange with the siding strip held in an approximately horizontal position to permit relative horizontal adjustment between the starter and siding strips, and thereafter the siding strip is pivoted about the return flange tip into a substantially vertical position for nailing to the associated structure.

7. A starter strip and siding strip as claimed in claim 1, wherein the gap between the tip of the return flange and the said starter strip front face is just sufficient to pass therethrough the hooked end of the siding strip with the siding strip held in an approximately horizontal position.

8. A starter strip and siding strip as claimed in claim 1, wherein the said siding strip hooked lower end is engageable over the tip of the starter strip return flange with the siding strip held in an approximately horizontal position to permit relative horizontal adjustment between the starter and siding strips, and thereafter the siding strip is pivoted about the return flange tip into a substantially vertical position for nailing to the associated structure, and wherein the width of the starter strip return flange is just less than the corresponding horizontal width of the inside of the siding strip hooked lower end to maintain engagement therebetween as the siding strip is rotated from the said horizontal position to the said vertical position.

* * * * *